US006023812A

United States Patent [19]

Morad

[11] Patent Number: 6,023,812

[45] Date of Patent: Feb. 15, 2000

[54] DUSTPAN APPARATUS

[75] Inventor: Fred I. Morad, Toluca Lake, Calif.

[73] Assignee: Worldwide Integrated Resources, Inc., Commerce, Calif.

[21] Appl. No.: 09/112,990

[22] Filed: Jul. 10, 1998

Related U.S. Application Data

[63] Continuation-in-part of application No. 08/988,888, Dec. 11, 1997, Pat. No. 5,911,258, which is a continuation-in-part of application No. 08/751,862, Nov. 18, 1996, Pat. No. 5,842,810.

[51] Int. Cl.[7] ..... A47L 13/52

[52] U.S. Cl. ..... 15/257.7; 15/257.1

[58] Field of Search ..... 15/257.1, 257.2, 15/257.3, 257.4, 257.5, 257.6, 257.7, 257.8, 257.9

[56] References Cited

U.S. PATENT DOCUMENTS

D. 359,605 6/1995 Janikowski .
D. 375,391 11/1996 Williams et al. .
3,432,873 3/1969 Moss .
3,795,934 3/1974 Moss .
4,722,634 2/1988 Malish .
5,366,314 11/1994 Young .
5,375,286 12/1994 Harrah .
5,481,777 1/1996 Nenninger .

FOREIGN PATENT DOCUMENTS

WO93/14687 8/1993 WIPO .

*Primary Examiner*—Randall E. Chin
*Attorney, Agent, or Firm*—Thomas I. Rozsa; Tony D. Chen; Jerry Fong

[57] ABSTRACT

A dustpan apparatus having a debris receiving member, a quick release adaptor member and a handle member. The debris receiving member has an enclosed wide body with a front lip and a pivotable bracket which is movably connected at opposite sides of the enclosed wide body. A threaded shaft is centrally located on the pivotable bracket, where the quick release adaptor member is adapted to be threadedly connected to the threaded shaft of the pivotable bracket. The adaptor member has a connection member for receiving and detachably attaching the handle member thereto.

19 Claims, 8 Drawing Sheets

FIG.1
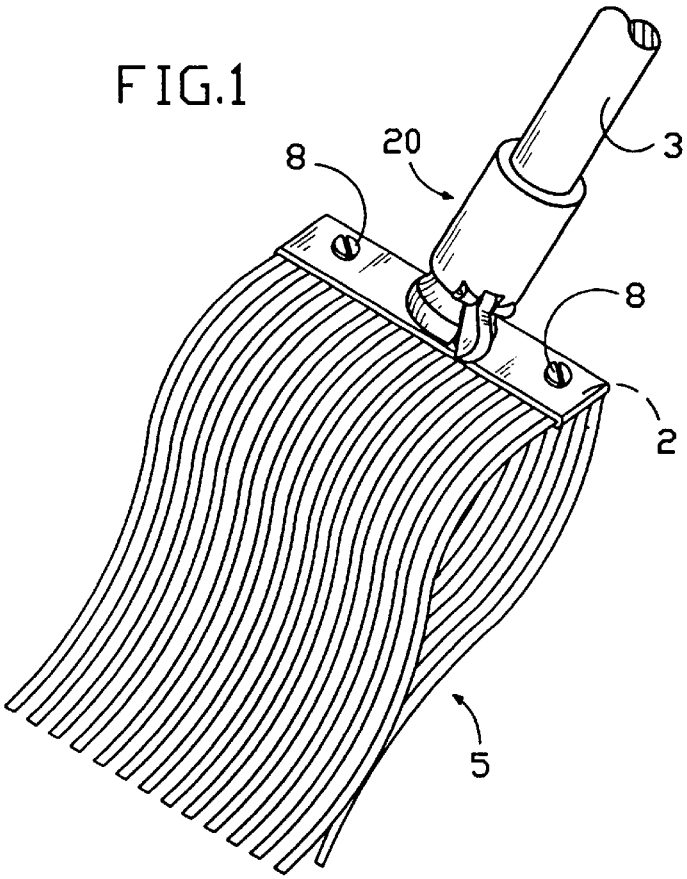
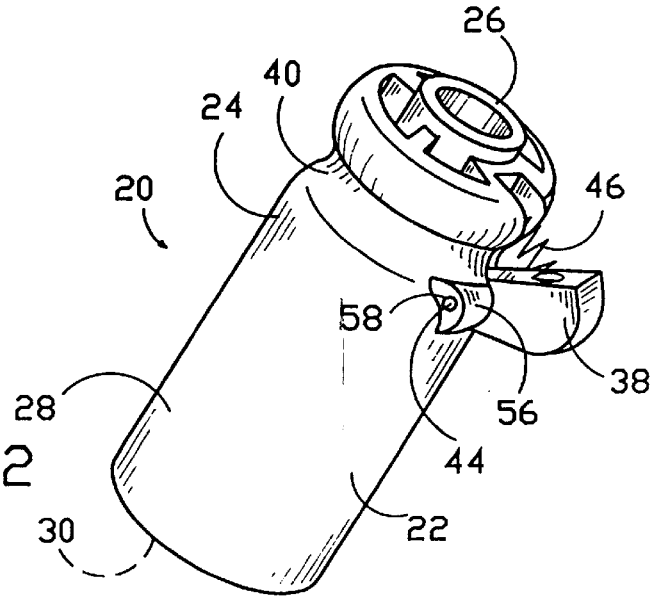
FIG.2

FIG.6
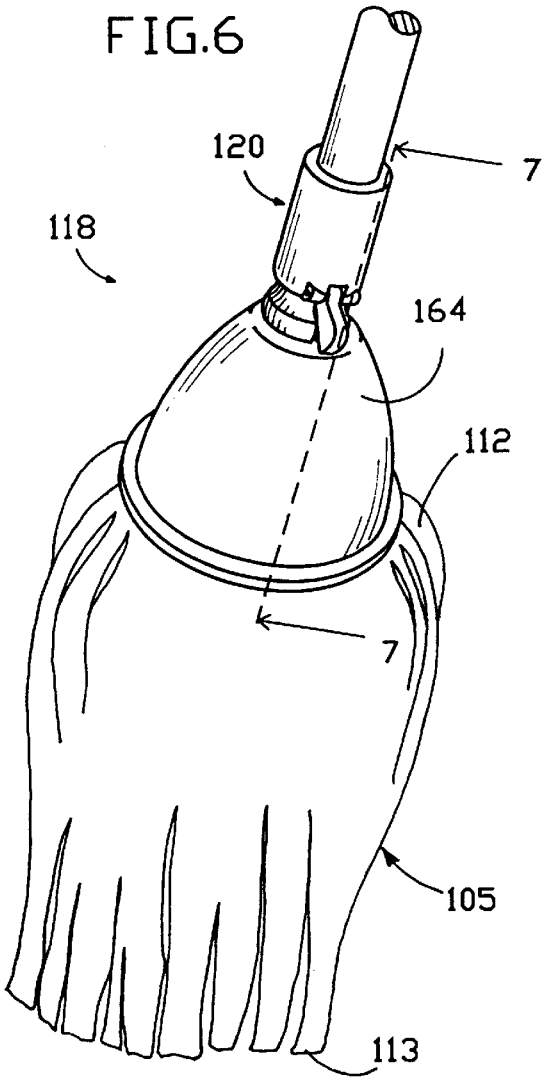
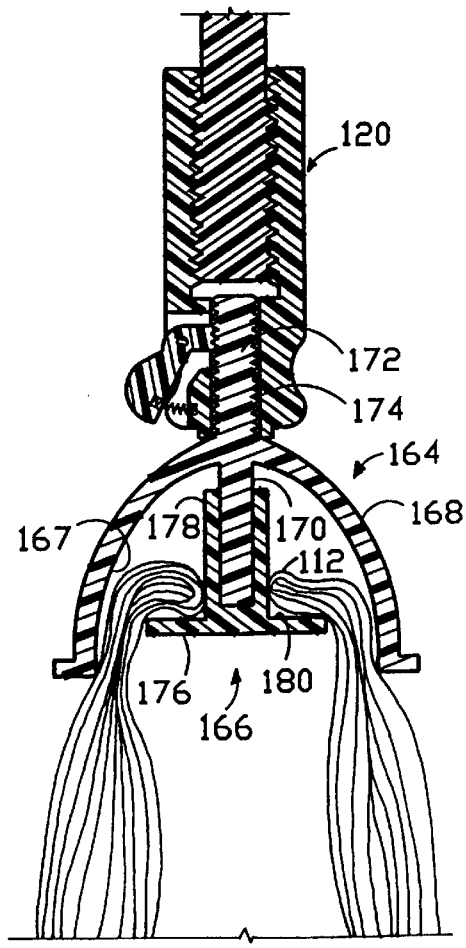
FIG.7

FIG.8
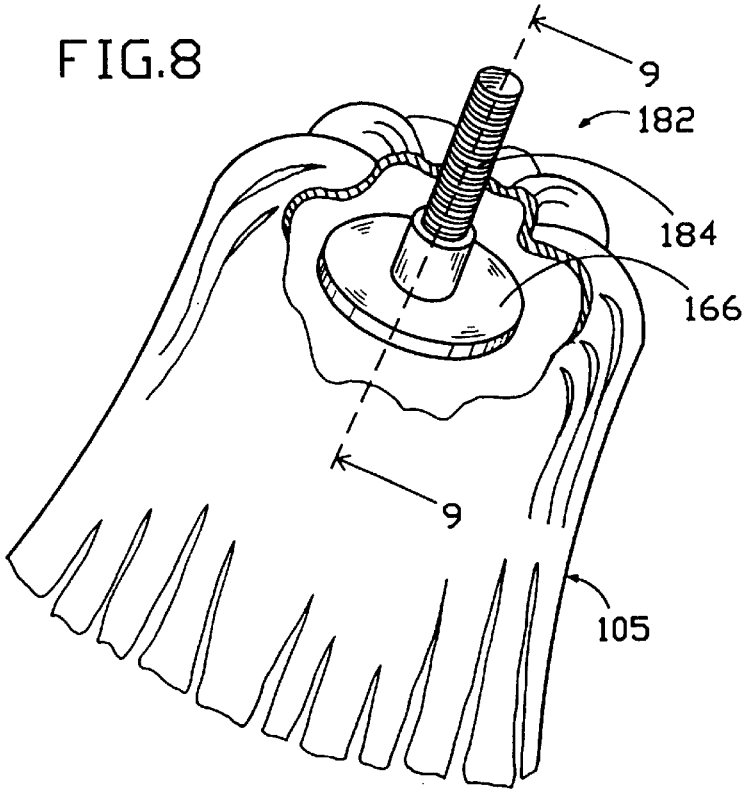
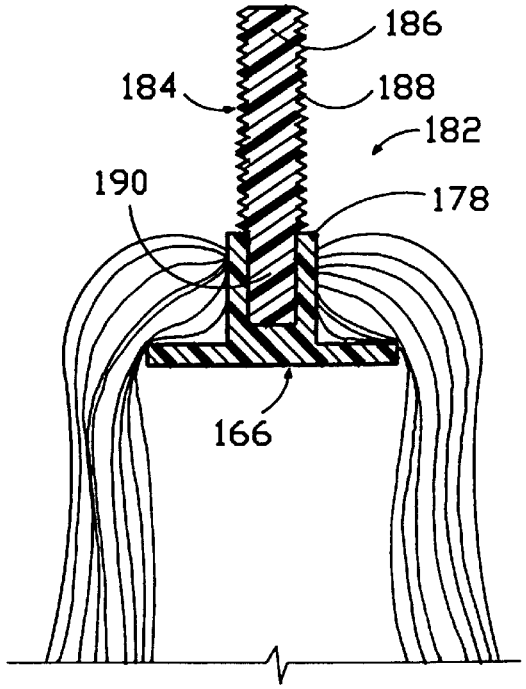
FIG.9

FIG.10
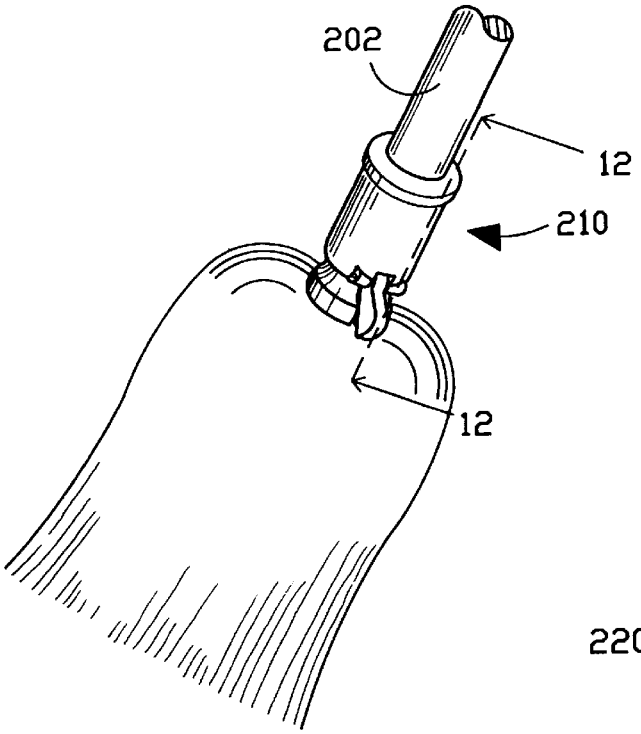
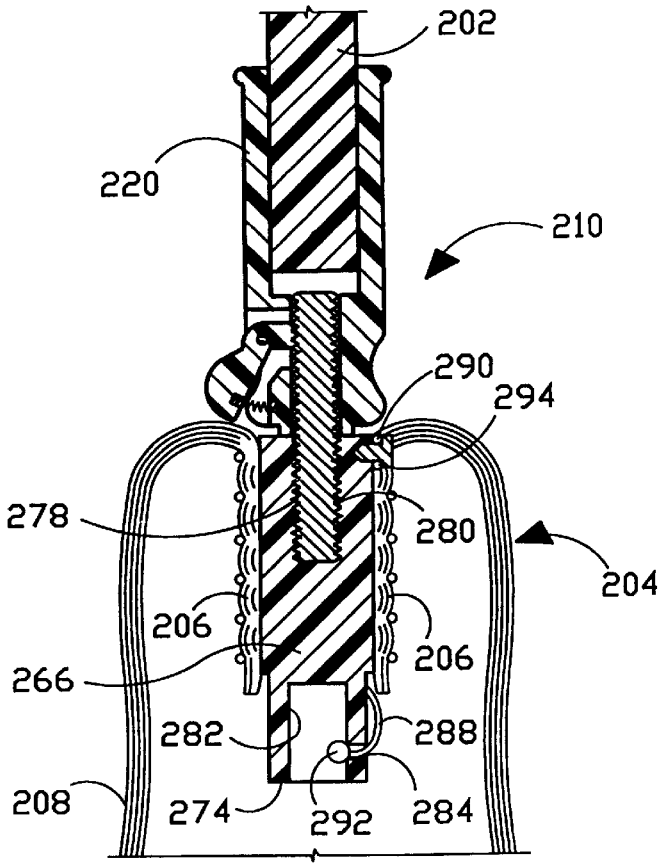
FIG.12

FIG.14
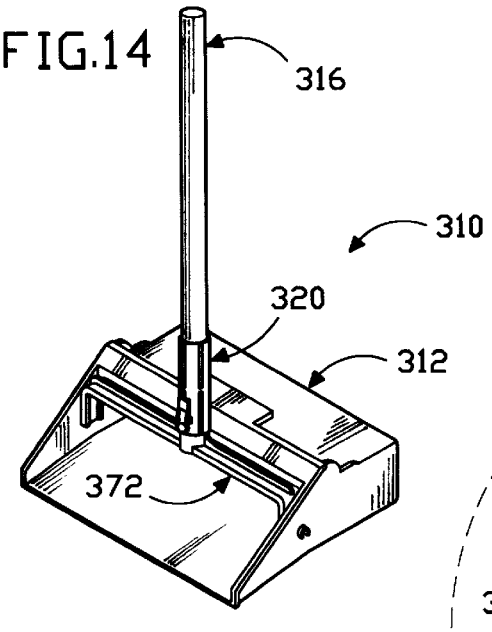
FIG.17
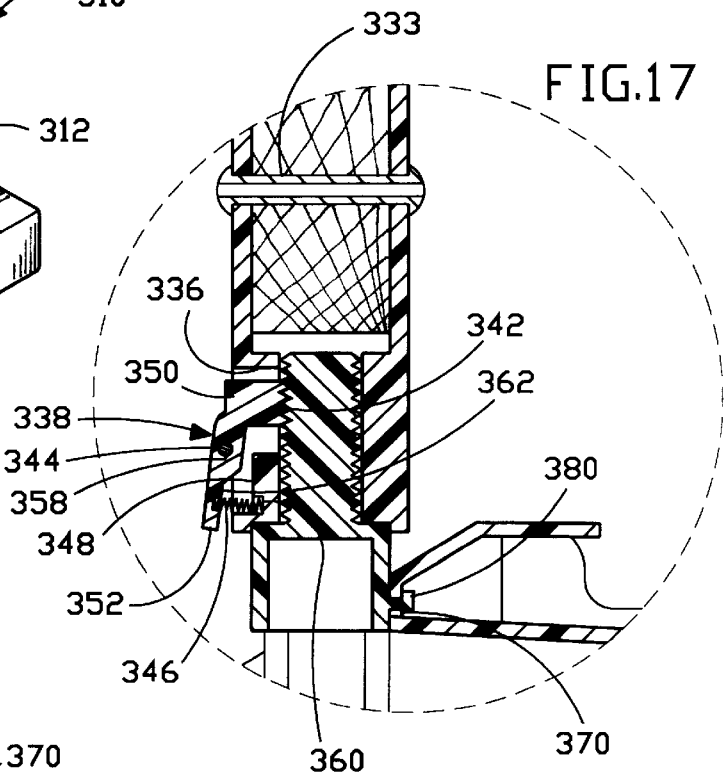
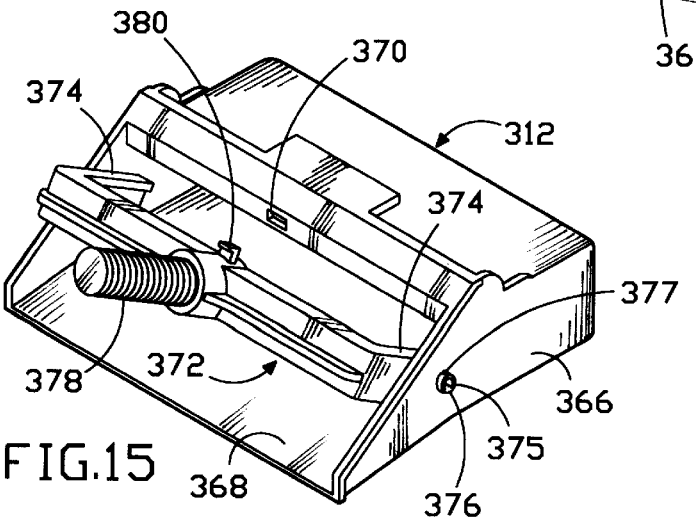
FIG.15

DUSTPAN APPARATUS

The present application is a continuation-in-part of application Ser. No. 08/988,888 filed Dec. 11, 1997, U.S. Pat. No. 5,911,258, which is a continuation-in-part of application Ser. No. 08/751,862 filed Nov. 18, 1996, U.S. Pat. No. 5,842,810

BACKGROUND OF THE INVENTION

1. Field of the Invention

The present invention generally relates to the field of mops and brooms. More particularly, the present invention relates to adaptors for adapting a mop head and handle to form a mop or a broom head and handle to form a complete broom. In particular, the present invention relates to dustpan apparatuses.

2. Description of the Prior Art

The inventor and applicant of the present invention is also the patentee of U.S. Pat. No. 5,230,596 issued on Jul. 27, 1993 (hereafter "the '596 Patent"). The inventor is aware of the prior art mop holders which were disclosed in the '596 Patent. While the patentee's prior art slidable and threadable quick release locking nut for quick change type mop holders functions adequately, the patentee has continuously sought to further improve mop holders for the consumer industry.

The '596 Patent discloses an improved quick release locking nut for quick change type mop holders. The mop holder has a frame attachable to a mop stick and a clamping member for securing mop fill. The quick release locking nut is slidably mounted on a central shank of the frame, and has a pivotally mounted pawl which is biased by a spring. The pawl has inner screw threads which engage with the outer screw threads on the central shank, in order to lock the quick release locking nut on the central shank for preventing the clamping member from sliding on the central shank. When the pawl is pressed against the spring and therefore is disengaged from the central shank, the quick release locking nut is unlocked and can slide on the central shank for allowing the clamping member to slide on the central shank so that the mop clamp can be released.

There is a need for an adaptor which can quickly fasten a mop head and a mop handle to form a complete mop. It is also desirable to provide an adaptor, where a user can quickly release the mop head from the adaptor by pressing a lever to release without getting his or her hands soiled. The mop head can then be thrown away after use or the mop head can be washed for further use.

Generally, prior art corn brooms are assembled by having broomcorns wound on a handle and attached to the handle by conventional means. Then the entire assembled broom including the handle and broomcorn attached thereon is shipped to retailers. The disadvantage with this is that it is very cumbersome and expensive way of shipping to the retailers. It would be much easier if the broomcorns could be wound on an adaptor and have the broomcorns with the adaptor shipped to the retailers and then have the broom handle connected at the site of the retailers. Another disadvantage with prior art brooms is that the corn broom portion is always used and deteriorates while the handle portion remains intact. Therefore, the handle portion is always discarded with the corn broom portion.

The following nine (9) prior art patents were further found to be pertinent to the field of the alternative present invention:

1. U.S. Pat. No. 3,432,873 issued to Moss on Mar. 18, 1969 for "Mop Construction" (hereafter the"'873 Moss Patent");

2. U.S. Pat. No. 3,795,934 issued to Moss on Mar. 12, 1974 for "Mop With Open Scrim HeadBand" (hereafter the "'934 Moss Patent");
3. U.S. Pat. No. 4,722,634 issued to Malish on Feb. 2, 1988 for "Adapter Device For Brooms Or The Like" (hereafter the "Malish Patent");
4. U.S. Pat. No. 5,366,314 issued to Young on Nov. 22, 1994 for "Connector For Detachably Connecting A Shaft To An Implement" (hereafter the "Young Patent");
5. U.S. Pat. No. 5,375,286 issued to Harrah on Dec. 27, 1994 for "Quick-Release Connector For Mop Handles And The Like" (hereafter the "Harrah Patent");
6. U.S. Pat. No. 5,481,777 issued to Nenninger on Jan. 9, 1996 for "Releasable Mop Head" (hereafter the "Nenninger Patent");
7. U.S. Design Pat. No. 359,605 issued to Janikowski on Jun. 20, 1995 for "Adjustable Mop" (hereafter the "Janikowski Patent");
8. U.S. Design Pat. No. 375,391 issued to Williams et al. on Nov. 5, 1996 for "Mop Head" (hereafter the "Williams Patent"); and
9. Patent Cooperation Treaty No. WO 93/14687 issued to Jones et al. for "A Connector" (hereafter the "Jones Patent").

The '873 Moss Patent discloses a mop construction. It comprises a mop which has a plurality of absorbent cords secured together to form two sides of the mop. A connecting device is attached to a midsection of the mop.

The '934 Moss Patent discloses a mop with an open scrim headband which allows penetration of teeth of a mop holder into the headband for fastening the mop to a mop handle.

The Malish Patent discloses an adapter device for brooms or the like. The adapter device is detachably connecting a broom to a handle. The adapter device includes a unitary body constructed with a multi-diameter interior defining an internal shoulder portion adapted to abuttingly receive the end of a handle and a multi-step-down exterior terminating in a threaded male end portion adapted to be frictionally coupled into the corresponding female threaded socket in the brush head.

The Young Patent discloses a connector for detachably connecting a shaft to an implement. It comprises two engagable components, a first component for mounting on a handle, and a second component adapted for mounting the head of a floor mop. The first component comprises a cylindrical socket adapted to fit tightly over the end of the handle. A central hollow spigot is coaxial with the socket and is formed with external screw threads. A co-axial circular shroud surrounds the spigot. The second component is mounted on the mop head. It comprises a cylindrical boss formed with an internal socket which is internally screw-threaded. The socket and threads correspond with the threaded spigot so that the spigot can be screwed tightly into the socket to join the two components of the connector together.

The Harrah Patent discloses an quick-release connector for mop handles and the like. The connector comprises a handle portion for attachment to the mop handle and a head portion for attachment to the mop head. The handle portion is a cylindrical member with a circular bore at one end to receive one end of the mop handle and which is permanently affixed thereto. The other end of the cylindrical handle portion has a relatively shallow recess adapted to mate with a corresponding protrusion on the head portion. Within the recess of the handle portion are a plurality of receptacles which mate with corresponding bayonet projections on the head portion. The two outside receptacles each connect or mate with a corresponding indentation in the sidewall of the cylindrical handle portion, when the head portion is connected to the handle portion. The head portion includes three corresponding bayonet projections. When the two portions are connected together, the center bayonet acts as a guide so that the outside bayonets and the mating protrusion and recess are properly oriented to each other. As the two portions are pushed together the outside bayonets are flexed inward until such time as the bayonets are fully received in a respective aperture and an outer surface of each of the outer bayonets aligns with a respective recess in the sidewall of the handle portion.

The Nenninger Patent discloses a releasable mop head for releasably securing absorbent mop material to a handle.

The Jones Patent discloses a connector. It comprises a male portion attached to an end of a pole and a female portion attached to a mop head. The female portion has a boss into which the male portion can be inserted. The interior of the boss has a plurality of tapered ribs which engage in a resilient manner with the male portion. The male portion has ribs which deform channels in the female portion. The deformation of the channels causes the boss to contact.

The Williams Patent discloses a mop head.

The Janikowski Patent discloses an adjustable mop.

It is further desirable to provide a broom apparatus for improving the way conventional corn brooms are assembled and thereafter shipped. It is also desirable to provide a broom apparatus, wherein broomcorns can be wound to a broomcorn adaptor, and thereby be much easier and less expensive to ship the entire assembled broom. The broom handle is then detachably attached to a quick release adaptor which is detachably connected to the broomcorn adaptor at the site of the retailers.

It is still further desirable to provide a dustpan apparatus for improving the way conventional dustpans are assembled and thereafter shipped. The dustpan handle can be detachably attached to a quick release adaptor which is detachably connected to a dustpan adaptor of the dustpan.

SUMMARY OF THE INVENTION

The present invention is a unique quick release adaptor for quickly connecting and releasing a T-shaped bar member which holds a mop head and a mop handle to form a complete mop for use. The present invention adaptor also quickly releases the T-shaped bar member which holds the mop head so that an individual does not have to get his or her hands soiled to remove the mop head from the handle.

It is known that a prior art T-shaped bar member has a horizontal base portion and a vertical portion. The horizontal base portion retains the mop head, while the vertical portion can be adapted to the present invention adaptor. A mop handle or stick can then be installed to the rear of the adaptor.

The quick release adaptor comprises a spring biased pawl which is pivotally mounted thereon, such that when the tip of the pawl is engaged with the vertical portion of the T-shaped bar member by the spring, it locks the movement of the adaptor. However, by simply rotating the adaptor, the adaptor will be further threaded on the vertical portion of the T-shaped bar member to precisely adjust the tightness of the adaptor to the T-shaped bar member. When the pawl is pressed against the spring, an individual can quickly release the adaptor from the vertical portion of the T-shaped bar member, which in turn releases the mop head which can be thrown away after use or washed without having the individual's hands soiled.

It is therefore an object of the present invention to provide an adaptor for adapting a T-shaped bar member or the like which holds a mop head and a mop handle thereto, and thereby forms a complete mop for use.

It is an additional object of the present invention to provide an adaptor which comprises a spring biased pawl pivotally mounted thereon, such that when the tip of the pawl is engaged with the T-shaped bar member by the spring, it locks the movement of the adaptor. However, by simply pressing the pawl against the spring, an individual can quickly release the T-shaped bar member which holds the mop head, which in turn falls out from the adaptor after use so that the individual will not get his or her hands soiled.

It is a further object of the present invention to provide an adaptor, where inner screw threads are provided on the engaging tip of the spring biased pawl so that the spring biased pawl is engaged to the vertical threaded portion of the T-shaped bar member, so that the adaptor can be further threaded on the vertical threaded portion of the T-shaped bar member to precisely adjust the tightness of the adaptor.

It is another object of the present invention to provide an apparatus which includes an adaptor for adapting a mop head and a mop handle thereto, and thereby forms a complete mop for use.

In the preferred embodiment, the present invention comprises a quick release adaptor member used in conjunction with a standard T-shaped bar member which retains a mop head.

In an alternative embodiment, the present invention apparatus comprises an adaptor member, a circular disc member, and a cone shaped cover member, where the cone shaped member is adapted to the circular disc member and the adaptor member is adapted to the circular disc member.

In another alternative embodiment, the present invention apparatus comprises an adaptor member, a circular disc member and a shaft member, where the shaft member is press fitted to the circular disc member which retains a mop head and the adaptor member is adapted to the shaft member.

Alternatively, the present invention is a broom apparatus for improving the way conventional corn brooms can be assembled and thereafter shipped. The apparatus includes a broomcorn attachment adaptor and a quick release adaptor adapted to be threadedly connected to the attachment adaptor. The attachment adaptor comprises an attachment portion and a threaded shaft portion protruding outwardly from the attachment portion for threadedly engaging with the quick release adaptor, wherein the quick release adaptor is provided with a handle connection means for receiving and detachably attaching a broom handle thereto. Broomcorns are wound on the attachment portion of the attachment adaptor to form a broom head.

It is still an object of the present invention to provide a broom apparatus which comprises a broom attachment adaptor and a quick release adaptor for improving the way conventional corn brooms can be assembled and shipped without the broom handle connected thereto, and thereby be able to assemble the broom handle to the broom apparatus at a later time, for example, at the retailer.

Further alternatively, the present invention is a dustpan apparatus for improving the way conventional dustpans can be assembled and thereafter shipped. The dustpan apparatus includes a debris receiving member, a quick release adaptor member and a handle member. The debris receiving member has an enclosed wide body with a front lip and a pivotable bracket which is movably connected at opposite sides of the enclosed wide body. A threaded shaft is integrally formed and centrally located on the pivotable bracket, where the quick release adaptor member is adapted to be threadedly connected to the threaded shaft of the pivotable bracket. The adaptor member is provided with a handle connection means for receiving and detachably attaching the handle member thereto.

It is still a further object of the present invention to provide a dustpan apparatus which comprises a debris receiving member, a quick release adaptor member and a handle member for improving the way conventional dustpan apparatuses can be assembled and shipped without the handle member being connected thereto, and thereby be able to assemble the handle member to the quick release adaptor member which in turn is detachably connected to the debris receiving member to form the dustpan apparatus.

It is still also a further object of the present invention to provide a dustpan apparatus which comprises a debris receiving member, a quick release adaptor member and a handle member, where the quick release adaptor member and the handle member can be reused with another debris receiving member.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is an illustration of the present invention adaptor adapted to a T-shaped bar, which holds a mop head, and a mop handle to form a complete mop;

FIG. 2 is a perspective view of the present invention quick release adaptor;

FIG. 6 is a perspective view of an alternative embodiment of the present invention apparatus used for adapting a mop head and a mop handle;

FIG. 7 is an enlarged cross-sectional view taken along line 7—7 of FIG. 6;

FIG. 8 is a partial cut-out perspective view of another alternative embodiment of the present invention apparatus used for adapting a mop head and a mop handle;

FIG. 9 is a cross-sectional view taken along line 9—9 of FIG. 8;

FIG. 10 is a perspective view of an alternative present invention of a broom apparatus;

FIG. 12 is a longitudinal cross-sectional view of the present invention broom apparatus shown in FIG. 10;

FIG. 14 is a perspective view illustrating still a further alternative embodiment of the invention dustpan apparatus;

FIG. 15 is a perspective view of a debris receiving member of the invention dustpan apparatus shown in FIG. 14;

FIG. 17 is an enlarged partial view taken within the dashed lines of FIG. 16.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 4:
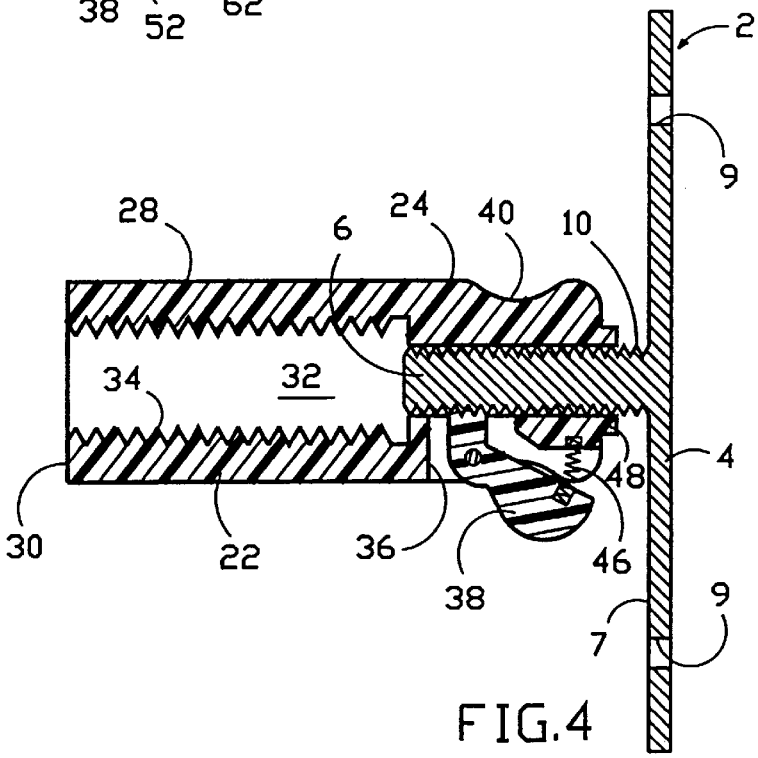
FIG. 4 is a longitudinal cross-sectional view of the present invention quick release adaptor adapted to the T-shaped bar which holes the mop head.

Referring to FIG. 1, there is shown an illustration of the present invention quick release adaptor member 20 for adapting and retaining a standard T-shaped bar member 2 which holds a standard mop head 5 and a standard mop handle 3 thereto. Referring to FIGS. 1 and 4, the T-shaped bar member 2 has a horizontal base portion 4 and a vertical portion 6 with external screw threads 10. The vertical portion 6 of the T-shaped bar member 2 is inserted through an aperture (not shown) provided on the mop head 5, such that the surface 7 of the horizontal base portion 4 abuts against the mop head 5 and is retained thereto by two opposite screws 8. The two screws 8 are inserted through two apertures 9 provided on the horizontal base portion 4 of the T-shaped bar member 2 and fastened by nuts (not shown). The screws 8 may be any conventional fastening means, such as rivets for retaining the horizontal base portion 4 to the mop head 5.

Figure 5:
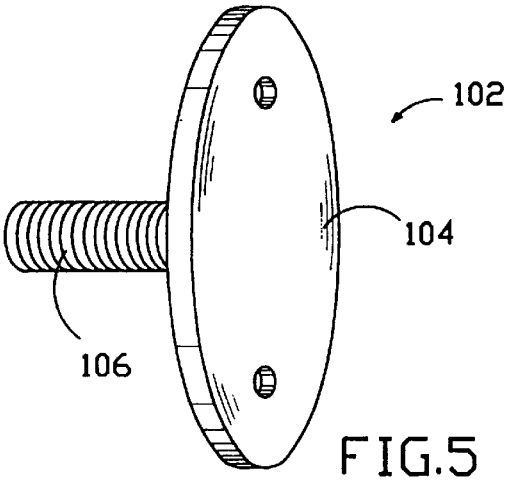
FIG. 5 is a perspective view of an alternative component used for adapting a mop head to the present invention quick release adaptor.

It will be appreciated that the T-shaped bar member 2 is not limited to the illustration shown in FIG. 4. It is emphasized that while the T-shaped bar member 2 is preferred with the present invention adaptor member 20, it is also within the spirit and scope of the present invention to utilize, for example, a circular disc member 102 which has a horizontal circular base portion 104 and a vertical portion 106 with external screw threads as shown in FIG. 5 or any other conventional part which may be attached to the mop head. The circular disc member 102 is installed exactly the same as the T-shaped bar member 2 described above, and the description thereof will not be repeated.

Figure 3:
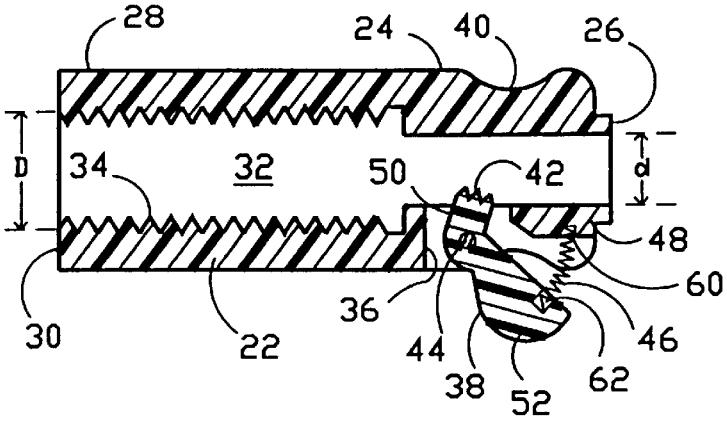
FIG. 3 is a longitudinal cross-sectional view of the present invention quick release adaptor.

Referring to FIGS. 2 and 3, there is shown a perspective view of the present invention adaptor member 20 which has a generally cylindrical shaped body 22. The cylindrical shaped body 22 comprises a proximal portion 24 with a proximal open end 26, a distal portion 28 with a distal open end 30, a central slot 32 extending from the proximal open end 26 to the distal open end 30 (see FIG. 3), and a side slot 36 located on the proximal portion 24. There is also an annular groove 40 provided on the exterior sidewall of the cylindrical body 22 of the adaptor member 20 that enables a user to handle the adaptor member 20 more easily, so that the user can firmly grip the body 22 to rotate it.

Referring to FIGS. 3 and 4, the central slot 32 has two different inner diameters, a smaller inner diameter "d" is for the proximal portion 24 and a larger inner diameter "D" for the distal portion 28. The smaller inner diameter "d" of the central slot 32 is used for accommodating the vertical portion 6 of the T-shaped bar member 2 while the larger inner diameter "D" has inner screw threads 34 for adapting the mop handle 3 to be threadedly engaged therein.

It will be appreciated that the present invention adaptor member 20 may be manufactured without inner screw threads 34 located on the distal portion 28 of the adaptor member 20 so that a mop handle 3 may be, for example, press fitted therein.

The side slot 36 interconnects with the central slot 32 on the proximal portion 24 and accommodates a pawl 38. A thin wall 48 is disposed between the central slot 32 and the side slot 36 to partially divide them, so the side slot 36 is partially connected with the central slot 32. The pawl 38 has an inwardly protruded tip 50 and an outwardly extended tail 52. The tip 50 is provided with inner screw threads 42 for engaging with the screw threads 10 of the vertical portion 6 of the T-shaped bar member 2 (see FIG. 4). The pawl 38 is pivotally mounted in the side slot 36 by a roll pin 44 and biased by a coil spring 46. There are two opposite protruding bosses 56 (only one is shown in FIG. 2) located on both sides of the pawl 38 and attached on the exterior sidewall of the cylindrical shaped body 22 of the adaptor member 20. Each protruding boss 56 has an aligned hole 58 therein, wherein the tip 50 is positioned therebetween, and a hole on the pawl 38, all for receiving the roll pin 44. In addition, there is an outward facing recess 60 provided on the thin wall 48, and an inward facing recess 62 provided on the pawl 38, for adapting the ends of the coil spring 46 respectively. As the pawl 38 is pivoted by the roll pin 44, it is biased by the coil spring 46, where its tip 50 is extending into the central slot 32 of the adaptor member 20 and its tail 52 is extending out of the side slot 36. The pawl 38 and the spring 46 are securely attached to the cylindrical shaped body 22 of the adaptor member 20. The width of the pawl 38 is approximately the same as the width of the side slot 36, so that when the spring 46 is installed in the side slot 36, it is not exposed to outside of the body 22 of the adaptor member 20.

Once the vertical portion 6 of the T-shaped bar member 2 is installed within the central slot 32 of the cylindrical shaped body 22 of the adaptor member 20, the screw threads 10 on the vertical portion 6 are engaged with the inner screw threads 42 on the tip 50 of the spring-biased pawl 38, where the tail 52 of the pawl 38 is not pressed. As the tail 52 of the pawl 38 is not pressed by the user, the pawl 38 will be biased by the coil spring 46. The pawl 38 is biased by the coil spring 46 such that its tip 50 is engaged with the vertical portion 6 of the T-shaped bar member 2. The adaptor member 20 is locked in place and prevents the vertical portion 6 of the T-shaped bar member 2 from sliding out from the adaptor member 20. The adaptor member 20 may be further threaded on the vertical portion 6 of the T-shaped bar member 2 to precisely adjust the tightness of the adaptor member 20 by further pushing the adaptor member 20 towards the T-shaped bar member 2 and rotating the body 22 in a clockwise direction or counter-clockwise direction, such that the inner screw threads 42 on the tip 50 of the pawl 38 engage with the screw threads 10 on the vertical portion 6 of the T-shaped bar member 2.

When the tail 52 of the pawl 38 is pressed against the coil spring 46, the vertical portion 6 of the T-shaped bar member 2 is released from the central slot 32 of the adaptor member 20, and the tip 50 of the pawl 38 is disengaged from the vertical portion 6 of the T-shaped bar member 2, which allows the vertical portion 6 of the T-shaped bar member 2 to slide freely out from the body 22 of the adaptor member 20. The T-shaped bar member 2 is slidable within the adaptor member 20 as the pawl 38 is pressed, thereby releasing the T-shaped bar member 2 from the adaptor member 20, which thereby becomes a very quick operation so that the T-shaped bar member and the mop head may quickly be released from the adaptor member 20 to be thrown away without having a person getting his or her hands soiled.

The present invention conforms to conventional forms of manufacture or any other conventional way known to one skilled in the art. The adaptor member 20 can be made from several materials. By way of example, the adaptor member 20 can be made of molded plastic or any other suitable material. The manufacturing process which could accommodate the construction of the adaptor member may be injection, thermoform, etc. or other molding process.

Referring to FIGS. 6 and 7, there is shown at 118 an adaptor assembly which is an alternative embodiment of the present invention for retaining a mop head 105 which has a fixed loop end 112 and an useable end 113 with a plurality of elongated strips. The adaptor assembly 118 comprises an adaptor member 120, a cone shaped cover member 164 and a circular disc-shaped retaining member 166. The adaptor member 120 is identical to and functions the same as the adaptor member 20 in the preceding embodiment, and the description thereof will not be repeated. The adaptor member parts are numbered correspondingly with 100 added to each reference number, and only the new components will now be described in detail below.

The cone shaped member 164 has an interior concave surface 167, an exterior convex surface 168, a central interior protruding shaft 170 extending from the concave surface 167, and a central exterior protruding shaft 172 extending from the convex surface 168. The exterior protruding shaft 172 has screw threads 174 so that the adaptor member 120 can be adapted thereon, which is similar to the preceding embodiment.

The circular disc-shaped member 166 has a circular portion 176 and a hollow cylindrical sleeve portion 178 which is integrally connected to the circular portion 176 and extends upwardly from an abutting surface 180 of the circular portion 176. The circular disc-shaped member 166 is installed by inserting the hollow cylindrical sleeve portion 178 through an aperture provided on the fixed loop end 112 of the standard loop mop 105. The central interior protruding shaft 170 of the cone shaped member 164 is then press fitted to the hollow cylindrical sleeve portion 178 of the circular disc shaped member 166 and secured thereto. The adaptor member 120 is then installed on the exterior protruding shaft 172 of the cone shaped member 164, and thereby functions the same as described in the preceding embodiment shown in FIGS. 1 through 4.

It will be appreciated that the cone-shaped cover member 164 is not limited to the way it is attached to the circular disc-shaped retaining member 166, where the interior protruding shaft 170 is press fitted to the hollow cylindrical sleeve portion 178. It is emphasized that while the press fit is the preferred method of attachment, it is also within the spirit and scope of the present invention to utilize, for example, a transverse roll pin extending through the hollow cylindrical sleeve portion 178 and the protruding shaft 170 or any other means known to one skilled in the art.

Referring to FIGS. 8 and 9, there is shown another adaptor assembly 182 which is another alternative embodiment of the present invention. The adaptor assembly 182 of the present invention is similar to the embodiment shown in FIGS. 6 and 7, except that the cone-shaped cover member 164 is removed and substituted with a unitary shaft member 184. The adaptor assembly 182 comprises an adaptor member not shown in FIGS. 8 and 9 because it is the same as the ones shown in the preceding figures, a circular disc-shaped retaining member 166 and a unitary shaft member 184. The adaptor member in this embodiment is identical to and functions the same as the adaptor members 20 and 120 in the preceding embodiments, and the description thereof will not be repeated. Also, the circular disc-shaped retaining member 166 is identical to and functions the same as the circular disc-shaped retaining member shown in FIGS. 6 and 7, and its description will not be repeated.

The unitary shaft member 184 has an upper portion 186 with external screw threads 188 and a lower portion 190. The unitary shaft member 184 is installed by press fitting the lower portion 190 to the hollow cylindrical sleeve portion 178 of the circular disc-shaped retaining member 166 and secured thereto. The adaptor member is then installed on the upper portion 186 of the unitary shaft member 184, and thereby functions the same as described in the preceding embodiment shown in FIGS. 1 through 4. Also, the lower portion 190 of the unitary shaft member 184 can be injected mold with the hollow cylindrical sleeve portion 178 of the circular disc-shaped retaining member 166, thereby forming a unitary one piece member, instead of two pieces.

Referring to FIGS. 10 through 13, there is shown alternatively the present invention broom apparatus 210 for adapting a broom handle 202 and a broom head 204 which is made from broomcorns, wherein the first ends 206 is fixedly attached thereto and the other ends 208 is free for sweeping. The apparatus 210 comprises a broomcorn attachment adaptor member 264 and a quick release adaptor member 220.

Figure 11:
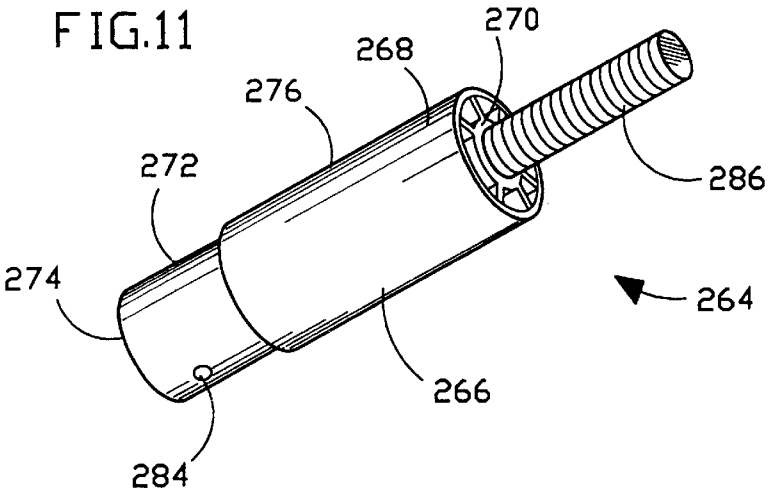
FIG. 11 is a perspective view of a broomcorn attachment adaptor of the present invention broom apparatus.
Figure 13:
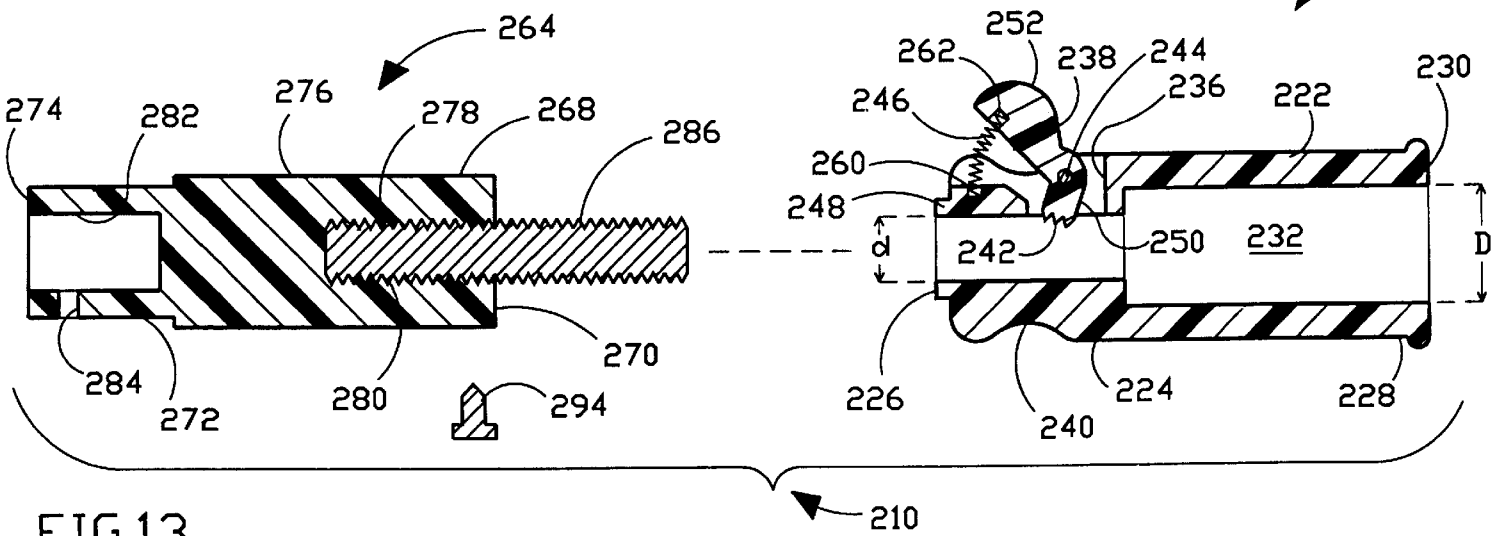
FIG. 13 is an exploded cross-sectional view of the present invention broom apparatus.

Referring to FIGS. 11, 12 and 13, the attachment adaptor member 264 has a generally cylindrical shaped body 266. The cylindrical shaped body 266 has a proximal portion 268 with a proximal end 270, a distal portion 272 with a distal open end 274, and a circumferential sidewall 276. The distal portion 272 has an inner bore 282 which communicates with the distal open end 274. The circumferential sidewall 276 has a side aperture 284 located adjacent to the distal open end 274, where the side aperture 284 communicates with the inner bore 282 of the distal portion 272.

A threaded shaft 286 is integrally molded at the proximal portion 268 of the cylindrical shaped body 266 of the attachment adaptor member 264 and partially extends outwardly therefrom at the proximal end 270. It will be appreciated that the cylindrical shaped body 266 of the attachment adaptor member 264 may be manufactured with an inner bore having inner screw threads 280, so that the threaded shaft 286 can be threaded thereto. It will be appreciated that the cylindrical shaped body 266 of the attachment adaptor member 264 may be manufactured with an inner bore without inner screw threads. If that is the case, the threaded shaft 286 may have a lower portion without screw threads thereto and the lower portion (without threads) can be press-fitted within the inner bore in the proximal portion 268 of the attachment adaptor member 264.

Referring to FIGS. 12 and 13, the broom apparatus 210 is provided with a nylon type wire or cord 288, or other suitable means. The cord 288 has a narrow end 290 and a wide end 292, where the narrow end 290 is inserted into the side aperture 284 from the interior of the inner bore 282 such that the wide end 292 prevents the wide end of the cord 288 from exiting out from the side aperture 284. The cord 288 is wound at the first ends 206 of broomcorns 204 to the circumferential sidewall 276 of the attachment adaptor member 264 for forming the broom head 204. The narrow end 290 is then secured to the circumferential sidewall 276 of the attachment adaptor member 264 by a screw means 294 or any other suitable means such as a nail to secure the broomcorns 204 thereto.

The quick release adaptor member 220 has a generally cylindrical shaped body 222 which comprises a proximal portion 224 with a proximal open end 226, a distal portion 228 with a distal open end 230, a central slot 232 extending from the proximal open end 226 to the distal open end 230, and a side slot 236 located on the proximal portion 224. There is also an annular groove 240 provided on the exterior sidewall of the cylindrical shaped body 222 of the adaptor member 220 that enables a user to handle the adaptor member 220 more easily, so that the user can firmly grip the cylindrical shaped body 222 to rotate it.

Referring to FIG. 13, the central slot 232 has two different inner diameters, a smaller inner diameter "d" is for the proximal portion 224 and a larger inner diameter "D" for the distal portion 228. The smaller inner diameter "d" of the central slot 232 is used for accommodating the threaded shaft 286 while the larger inner diameter "D" is adapted to receive the broom handle therein. The broom handle 202 (shown in FIGS. 10 and 12) is press-fitted within the distal portion 228 of the adaptor member 220. It will be appreciated that the adaptor member 220 may be manufactured with inner screw threads located on the distal portion 228 of the adaptor member 220 so that a broom handle 202 may be, for example, threaded therein as shown in FIGS. 3 and 4.

The side slot 236 interconnects with the central slot 232 on the proximal portion 224 and accommodates a pawl 238. A thin wall 248 is disposed between the central slot 232 and the side slot 236 to partially divide them, so the side slot 236 is partially connected with the central slot 232. The pawl 238 has an inwardly protruded tip 250 and an outwardly extended tail 252. The tip 250 is provided with inner screw threads 242 for engaging with the threaded shaft 286. The pawl 238 is pivotally mounted in the side slot 236 by a roll pin 244 and biased by a coil spring 246. There are two opposite protruding bosses located on both sides of the pawl 238 and attached on the exterior sidewall of the cylindrical shaped body 222 of the adaptor member 220. Each protruding boss has an aligned hole therein, wherein the tip 250 is positioned therebetween, and a hole on the pawl 238, all for receiving the roll pin 244. In addition, there is an outward facing recess 260 provided on the thin wall 248, and an inward facing recess 262 provided on the pawl 238, for respectively adapting the ends of the coil spring 246. As the pawl 238 is pivoted by the roll pin 244, it is biased by the coil spring 246, where its tip 250 is extending into the central slot 232 of the adaptor member 220 and its tail 252 is extending out of the side slot 236. The pawl 238 and the spring 246 are securely attached to the cylindrical shaped body 222 of the adaptor member 220. The width of the pawl 238 is approximately the same as the width of the side slot 236, so that when the spring 246 is installed in the side slot 236, it is not exposed to outside of the body 222 of the adaptor member 220.

Once the threaded shaft 286 is installed within the central slot 232 of the cylindrical shaped body 222 of the adaptor member 220, the threaded shaft 286 is engaged with the inner screw threads 242 on the tip 250 of the spring-biased pawl 238, where the tail 252 of the pawl 238 is not pressed.

As the tail 252 of the pawl 238 is not pressed by the user, the pawl 238 will be biased by the coil spring 246. The pawl 238 is biased by the coil spring 246 such that its tip 250 is engaged with the threaded shaft 286. The adaptor member 220 is locked in place and prevents the attachment adaptor member 264 from sliding out of the adaptor member 220. The adaptor member 220 may be further threaded on the threaded shaft 286 to precisely adjust the tightness of the adaptor member 220 by further pushing the adaptor member 220 towards the attachment member 264 and rotating the body 222 of the adaptor member 220 in a clockwise direction or counter-clockwise direction, such that the inner screw threads 242 on the tip 250 of the pawl 238 engage with the threaded shaft 286.

When the tail 252 of the pawl 238 is pressed against the coil spring 246, the threaded shaft 286 is released from the central slot 232 of the adaptor member 220, and the tip 250 of the pawl 238 is disengaged from the threaded shaft 286, which allows the threaded shaft 286 to slide freely out from the body 222 of the adaptor member 220. The threaded shaft 286 is slidable within the adaptor member 220 as the pawl 238 is pressed, thereby releasing the attachment member 264 from the adaptor member 220, which thereby becomes a very quick operation so that the attachment member 264 may quickly be released from the adaptor member 220.

The present invention conforms to conventional forms of manufacture or any other conventional way known to one skilled in the art. The attachment member 264 and the adaptor member 220 can be made from several materials. By way of example, the attachment 264 and adaptor 220 members can be made of molded plastic or any other suitable material. The manufacturing process which could accommodate the construction of the adaptor member may be injection, thermoform, etc. or other molding process.

Referring to FIG. 14, there is shown an illustration of the invention dustpan apparatus 310 which is comprised of a debris receiving member 312, a pivotable bracket member 372, a quick release adaptor member 320 and an elongated handle member 316.

Figure 16:
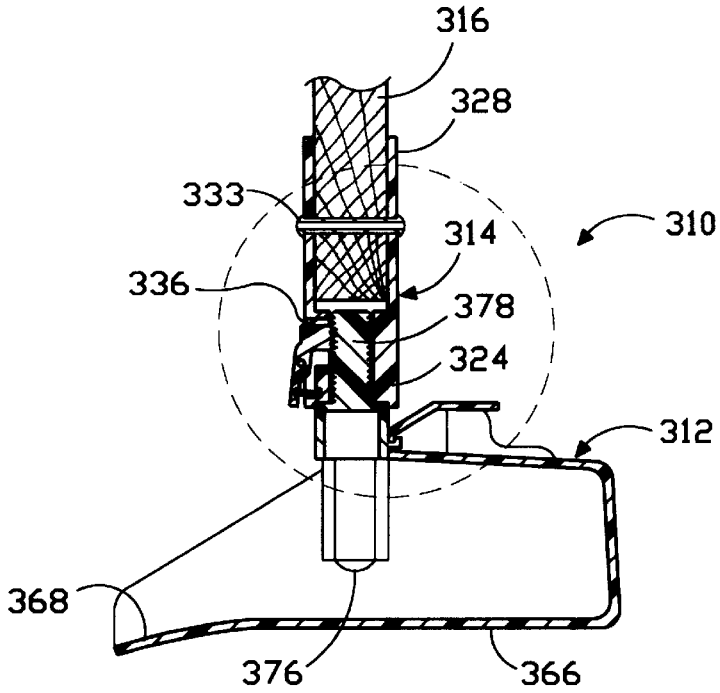
FIG. 16 is a longitudinal cross-sectional view of the invention dustpan apparatus.

Referring to FIGS. 14, 15 and 16, the debris receiving member 312 has a generally enclosed wide body 366 with a front lip 368 and an upper retaining means 370 which is a wide aperture located remote from the front lip 368. The enclosed wide body 366 is used for receiving and retaining debris therein.

The pivotable bracket member 372 has a generally wide yoke shaped body with two opposite arms 374 extending downwardly therefrom and are movably connected at opposite sides of the enclosed wide body 366 of the debris receiving member 312. Each arm 374 has an outwardly side protruding flange 375 (only one is shown, see FIG. 15) which is adapted to be inserted into a side aperture 376 (only one is shown) located on the enclosed wide body 366 and secured thereto by a bulge portion 377 on the protruding flange 375. A threaded shaft 378 is integrally formed thereto and centrally located on the yoke shaped body of the pivotable bracket member 372. A latching means 380 is integrally formed with the yoke shaped body of the pivotable bracket member 372 and located adjacent to the threaded shaft 378 for latching to the wide aperture 370 on the debris receiving member 312 to immobilize the pivotable bracket member 372 from moving.

Figure 18:
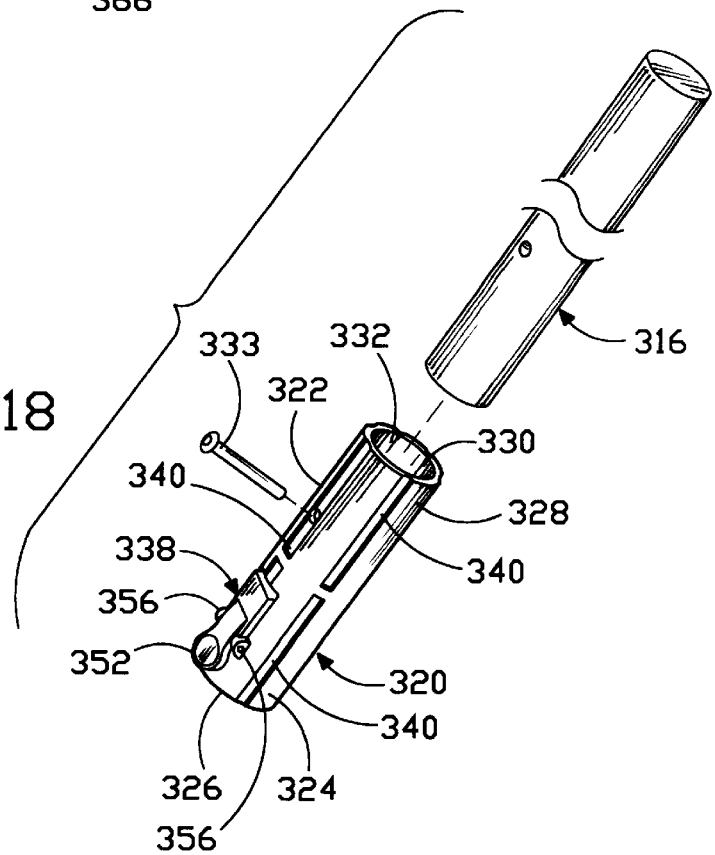
FIG. 18 is an exploded perspective view of a quick release adaptor member and a handle member of the invention dustpan apparatus.

Referring to FIGS. 16, 17 and 18, the adaptor member 320 has a generally cylindrical shaped body 322 which comprises a proximal portion 324 with a proximal open end 326, a distal portion 328 with a distal open end 330, a central bore 332 extending from the proximal open end 326 through the distal open end 330, and a side slot 336 located on the proximal portion 324. There is also a plurality of longitudinal grooves 340 provided on the exterior sidewall of the adaptor member 320 which enables a user to grip the adaptor member 320 more easily, so that the user can firmly grip the body 322 to rotate it.

The central bore 332 has two different inner diameters, a smaller inner diameter which is located on the proximal portion 324 and a larger inner diameter which is located on the distal portion 328. The smaller inner diameter of the central bore 332 is used for accommodating the threaded shaft 378 of the pivotable bracket member 372 while the larger inner diameter is used for adapting one end of the handle member 316 which is then secured to the adaptor member 320 by a retaining means such as a rivet 333 or a bolt and nut or a nail or any other conventional means know to one skilled in the art.

It will be appreciated that the adaptor member 320 may be manufactured with inner screw threads (not shown) which are located on the interior distal portion 328 of the adaptor member 320 so that the handle member 316 may be, for example, threadedly screwed therein.

Referring to FIGS. 17 and 18, the side slot 336 interconnects with the central bore 332 on the proximal portion 324 and accommodates a pawl 338. A thin partition 348 is disposed between the central bore 332 and the side slot 336 to partially divide them, so the side slot 336 is partially connected with the central bore 332. The pawl 338 has an inwardly protruded tip 350 and an outwardly extended tail 352. The tip 350 is provided with inner screw threads 342 for engaging with the thread shaft 378 of the pivotable bracket member 372. The pawl 338 is pivotally mounted in the side slot 336 by a roll pin 344 and biased by a coil spring 346. There are two opposite protruding bosses 356 (see FIG. 18) located on both sides of the pawl 338 and integrally formed on the exterior sidewall of the cylindrical shaped body 322 of the adaptor member 320. Each protruding boss 356 has an aligned hole 358 therein, wherein the tip 350 is positioned therebetween, and a hole on the pawl 338, all for receiving the roll pin 344. In addition, there is an outward facing recess 360 provided on the thin partition 348, and an inward facing recess 362 provided on the pawl 338, for respectively adapting the ends of the coil spring 346. As the pawl 338 is pivoted by the roll pin 344, it is biased by the coil spring 346, where its tip 350 is extending into the central bore 332 of the adaptor member 320 and its tail 352 is extending out of the side slot 336. The pawl 338 and the spring 346 are securely attached to the cylindrical shaped body 322 of the adaptor member 320. The width of the pawl 338 is approximately the same as the width of the side slot 336, so that when the spring 346 is installed in the side slot 336, it is not exposed to outside of the body 322 of the adaptor member 320.

Once the threaded shaft 378 of the pivotable bracket member 372 is installed within the central bore 332 of the cylindrical shaped body 322 of the adaptor member 320, the screw threads on the threaded shaft 378 are engaged with the inner screw threads 342 on the tip 350 of the spring-biased pawl 338, where the tail 352 of the pawl 338 is not pressed. As the tail 352 of the pawl 338 is not pressed by the user, the pawl 338 will be biased by the coil spring 346 such that its tip 350 is engaged with the threaded shaft 378 of the pivotable bracket member 372. The adaptor member 320 is locked in place and prevents the threaded shaft 378 of the pivotable bracket member 372 from sliding out from the adaptor member 320. The adaptor member 320 may be further threaded on the threaded shaft 378 to precisely adjust the tightness of the adaptor member 320 by further pushing the adaptor member 320 towards the pivotable bracket member 372 and rotating the body 322 in a clockwise direction or counter-clockwise direction, such that the inner screw threads 342 on the tip 350 of the pawl 338 engage with the screw threads on the threaded shaft 378 of the pivotable bracket member 372.

When the tail 352 of the pawl 338 is pressed against the coil spring 346, the threaded shaft 378 of the pivotable bracket member 372 is released from the central bore 332 of the adaptor member 320, and the tip 350 of the pawl 338 is disengaged from the threaded shaft 378 of the pivotable bracket member 372, which allows the threaded shaft 378 to slide freely out from the adaptor member 320. The threaded shaft 378 of the pivotable bracket member 372 is slidable within the adaptor member 320 as the pawl 338 is pressed, thereby releasing the threaded shaft 378 from the adaptor member 320, which thereby becomes a very quick operation so that the adaptor member 320 may be quickly released from the threaded shaft 378 of the pivotable bracket member 372.

The present invention conforms to conventional forms of manufacture or any other conventional way known to one skilled in the art. The receiving member 312, the adaptor member 320, the pivotable bracket member 372, and the handle member 316 can be made from several materials. By way of example, the receiving member 312, the pivotable bracket member 372 and the adaptor member 320 can be made of molded plastic or any other suitable material, while the handle member 316 can be made of wood or any other suitable material.

Defined in detail, the present invention is a dustpan apparatus, comprising: (a) a debris receiving member having an enclosed wide body for receiving and retaining debris therein, the enclosed wide body having a front lip and a first retaining means remote from the front lip; (b) a pivotable bracket movably connected at opposite sides of the enclosed wide body and having a threaded shaft integrally formed thereto and centrally located, the pivotable bracket further having a latching means integrally formed thereto for latching to the first retaining means of the enclosed wide body to immobilize the pivotable bracket from moving, where the threaded shaft is located in a vertical direction; (c) a quick release adaptor having a generally cylindrical shaped body, the cylindrical shaped body having a proximal portion with a proximal open end, a distal portion with a distal open end, a central bore extending from the proximal open end through the distal open end, and a side slot interconnecting the central bore and located on the proximal portion, where the central bore receives the threaded shaft of the pivotable bracket in the proximal portion of the quick release adaptor; (d) a pawl pivotally mounted in the side slot of the cylindrical shaped body of the adaptor and having a tip with inner screw threads; (e) a coil spring being installed in the side slot of the cylindrical shaped body of the adaptor and biasing the tip of the pawl for engaging the tip of the pawl to the threaded shaft of the pivotable bracket; (f) a thin partition disposed between the central bore and the side slot to partially divide them, so that the side slot is partially connected with the central bore; (g) the thin partition having an outward facing recess for adapting to one end of the coil spring; (h) the pawl having an inward facing recess located remote from the tip for adapting to the other end of the coil spring; (i) the cylindrical shaped body of the adaptor rotatable on the threaded shaft of the pivotable bracket such that the inner screw threads on the pawl threadedly engage with the threaded shaft of the pivotable bracket; and (j) an elongated handle member detachably attached to the quick release adaptor from the distal open end and secured thereto by a second retaining means; (k) whereby when the pawl is biased by the coil spring, the tip is engagable with the threaded shaft of the pivotable bracket such that the cylindrical shaped body of the adaptor is lockable on the threaded shaft for preventing the adaptor from sliding out from the threaded shaft, and the cylindrical shaped body of the adaptor is further threadable on the threaded shaft to precisely adjust the tightness of the cylindrical shaped body of the adaptor, and when the pawl is pressed against the coil spring, the tip is disengagable from the threaded shaft and the cylindrical shaped body of the adaptor is unlocked and is slidable out from the threaded shaft for quick release.

Defined broadly, the present invention is a dustpan apparatus, comprising: (a) a debris enclosed receiving member for receiving and retaining debris therein and having a front lip and a first retaining means remote from the front lip; (b) a pivotable bracket movably connected at opposite sides of the enclosed receiving member and having a threaded shaft which is centrally located and a latching means for latching to the first retaining means to immobilize the pivotable bracket from moving; (c) an adaptor member having a proximal portion with a proximal open end, a distal portion with a distal open end, a central bore extending from the proximal open end to the distal open end, and a side slot interconnecting the central bore and located on the proximal portion, where the central bore receives the threaded shaft of the pivotable bracket in the proximal portion of the adaptor member; (d) a pawl pivotally mounted in the side slot of the adaptor and having a tip with inner screw threads; (e) a spring being installed in the side slot of the adaptor and biasing the tip of the pawl for engaging the tip of the pawl to the threaded shaft of the pivotable bracket; (f) the adaptor member rotatably connected on the threaded shaft of the pivotable bracket such that the inner screw threads on the pawl are threadedly engagable with the threaded shaft; and (g) a handle member detachably attached to the adaptor member from the distal open end and secured thereto by a second retaining means; (h) whereby when the pawl is biased by the spring, the tip is engagable with the threaded shaft of the pivotable bracket such that the adaptor is lockable on the threaded shaft of the pivotable bracket for preventing the adaptor from sliding out from the pivotable bracket, and the adaptor can be further threaded on the threaded shaft to precisely adjust the tightness of the adaptor, and when the pawl is pressed against the spring, the tip is disengagable from the threaded shaft and the adaptor is unlocked and is slidable out from the threaded shaft for quick release.

Defined more broadly, the present invention is a dustpan apparatus, comprising: (a) a debris receiving member for receiving and retaining debris therein; (b) a bracket member movably connected to the debris receiving member and having a threaded portion; (c) an adaptor member having a central bore for receiving the threaded portion of the bracket member and a side slot interconnecting to the central bore; (d) a pawl pivotally mounted to the adaptor member and biased by a spring means such that a tip of the pawl is engaged onto the threaded portion of the bracket member, the spring means being installed in the side slot; (e) the tip of the spring biased pawl further having inner threads threadedly engaging the threaded portion of the bracket member for locking the adaptor member to the bracket member; and (f) a handle member detachably attached to the adaptor member and secured thereto by a retaining means; (g) whereby when the pawl is biased by the spring means, the tip is engaged with the threaded portion of the bracket member such that the adaptor member is locked on the threaded portion of the bracket member for preventing the adaptor member from sliding out from the threaded portion of the bracket member, and the adaptor member can be further threaded onto the threaded portion of the bracket member to precisely adjust the tightness of the adaptor member, and when the spring biased pawl is pressed against the spring means, the tip is disengaged from the threaded portion of the bracket member and the adaptor member is unlocked and can be slid out from the threaded portion of the bracket member for quick release.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A dustpan apparatus, comprising:

a. a debris receiving member having an enclosed wide body for receiving and retaining debris therein, the enclosed wide body having a front lip and a first retaining means remote from the front lip;

b. a pivotable bracket movably connected at opposite sides of said enclosed wide body and having a threaded shaft integrally formed thereto and centrally located, the pivotable bracket further having a latching means integrally formed thereto for latching to said first retaining means of said enclosed wide body to immobilize the pivotable bracket from moving, where the threaded shaft is located in a vertical direction;

c. a quick release adaptor having a generally cylindrical shaped body, the cylindrical shaped body having a proximal portion with a proximal open end, a distal portion with a distal open end, a central bore extending from the proximal open end through the distal open end, and a side slot interconnecting the central bore and located on the proximal portion, where the central bore receives said threaded shaft of said pivotable bracket in the proximal portion of the quick release adaptor;

d. a pawl pivotally mounted in said side slot of said cylindrical shaped body of said adaptor and having a tip with inner screw threads;

e. a coil spring being installed in said side slot of said cylindrical shaped body of said adaptor and biasing said tip of said pawl for engaging said tip of said pawl to said threaded shaft of said pivotable bracket;

f. a thin partition disposed between said central bore and said side slot to partially divide them, so that said side slot is partially connected with said central bore;

g. said thin partition having an outward facing recess for adapting to one end of said coil spring;

h. said pawl having an inward facing recess located remote from said tip for adapting to the other end of said coil spring;

i. said cylindrical shaped body of said adaptor rotatable on said threaded shaft of said pivotable bracket such that said inner screw threads on said pawl threadedly engage with said threaded shaft of said pivotable bracket; and j. an elongated handle member detachably attached to said quick release adaptor from said distal open end and secured thereto by a second retaining means;

k. whereby when said pawl is biased by said coil spring, said tip is engagable with said threaded shaft of said pivotable bracket such that said cylindrical shaped body of said adaptor is lockable on said threaded shaft for preventing said adaptor from sliding out from said threaded shaft, and said cylindrical shaped body of said adaptor is further threadable on said threaded shaft to precisely adjust the tightness of said cylindrical shaped body of said adaptor, and when said pawl is pressed against said coil spring, said tip is disengagable from said threaded shaft and said cylindrical shaped body of said adaptor is unlocked and is slidable out from said threaded shaft for quick release.

2. The dustpan apparatus in accordance with claim 1 wherein said cylindrical shaped body of said quick release adaptor is made of plastic material.

3. The dustpan apparatus in accordance with claim 1 wherein said first retaining means includes an upper aperture on said debris receiving member and aligned with said latching means.

4. The dustpan apparatus in accordance with claim 1 wherein said second retaining means includes a rivet.

5. The dustpan apparatus in accordance with claim 1 wherein said quick release adaptor is made of plastic material.

6. A dustpan apparatus, comprising:

a. a debris enclosed receiving member for receiving and retaining debris therein and having a front lip and a first retaining means remote from the front lip;

b. a pivotable bracket movably connected at opposite sides of said enclosed receiving member and having a threaded shaft which is centrally located and a latching means for latching to said first retaining means to immobilize the pivotable bracket from moving;

c. an adaptor member having a proximal portion with a proximal open end, a distal portion with a distal open end, a central bore extending from the proximal open end to the distal open end, and a side slot interconnecting the central bore and located on the proximal portion, where the central bore receives said threaded shaft of said pivotable bracket in the proximal portion of the adaptor member;

d. a pawl pivotally mounted in said side slot of said adaptor and having a tip with inner screw threads;

e. a spring being installed in said side slot of said adaptor and biasing said tip of said pawl for engaging said tip of said pawl to said threaded shaft of said pivotable bracket;

f. said adaptor member rotatably connected on said threaded shaft of said pivotable bracket such that said inner screw threads on said pawl are threadedly engagable with said threaded shaft; and g. a handle member detachably attached to said adaptor member from said distal open end and secured thereto by a second retaining means;

h. whereby when said pawl is biased by said spring, said tip is engagable with said threaded shaft of said pivotable bracket such that said adaptor is lockable on said threaded shaft of said pivotable bracket for preventing said adaptor from sliding out from said pivotable bracket, and said adaptor can be further threaded on said threaded shaft to precisely adjust the tightness of said adaptor, and when said pawl is pressed against said spring, said tip is disengagable from said threaded shaft and said adaptor is unlocked and is slidable out from said threaded shaft for quick release.

7. The dustpan apparatus in accordance with claim 6 further comprising a thin partition disposed between said central bore and said side slot to partially divide them, so that said side slot is partially connected with said central bore.

8. The dustpan apparatus in accordance with claim 7 wherein said thin partition has an outward facing recess for adapting to one end of said spring.

9. The dustpan apparatus in accordance with claim 6 wherein said pawl has an inward facing recess located remote from said tip for adapting to the other end of said spring.

10. The dustpan apparatus in accordance with claim 6 wherein said adaptor member is made of plastic material.

11. The dustpan apparatus in accordance with claim 6 wherein said first retaining means includes an upper aperture on said debris receiving member and aligned with said latching means to secure said pivotable bracket from moving.

12. The dustpan apparatus in accordance with claim 6 wherein said second retaining means includes a rivet.

13. A dustpan apparatus, comprising:

a. a debris receiving member for receiving and retaining debris therein;

b. a bracket member movably connected to said debris receiving member and having a threaded portion;

c. an adaptor member having a central bore for receiving said threaded portion of said bracket member and a side slot interconnecting to the central bore;

d. a pawl pivotally mounted to said adaptor member and biased by a spring means such that a tip of the pawl is engaged onto said threaded portion of said bracket member, the spring means being installed in said side slot;

e. said tip of said spring biased pawl further having inner threads threadedly engaging said threaded portion of said bracket member for locking said adaptor member to said bracket member; and f. a handle member detachably attached to said adaptor member and secured thereto by a retaining means;

g. whereby when said pawl is biased by said spring means, said tip is engaged with said threaded portion of said bracket member such that said adaptor member is locked on said threaded portion of said bracket member for preventing said adaptor member from sliding out from said threaded portion of said bracket member, and said adaptor member can be further threaded onto said threaded portion of said bracket member to precisely adjust the tightness of said adaptor member, and when said spring biased pawl is pressed against said spring means, said tip is disengaged from said threaded portion of said bracket member and said adaptor member is unlocked and can be slid out from said threaded portion of said bracket member for quick release.

14. The dustpan apparatus in accordance with claim 13 further comprising a thin partition disposed between said central bore and said side slot to partially divide them, so that said side slot is partially connected with said central bore.

15. The dustpan apparatus in accordance with claim 14 wherein said thin partition has an outward facing recess for adapting to one end of said spring means.

16. The dustpan apparatus in accordance with claim 13 wherein said pawl has an inward facing recess located remote from said tip for adapting to the other end of said spring means.

17.The dustpan apparatus in accordance with claim 13 wherein said debris receiving member further comprises a front lip and an upper aperture remote from the front lip.

18. The dustpan apparatus in accordance with claim 17 wherein said bracket member further comprises a latching means for latching to said upper aperture of said debris receiving member to immobilize said bracket member from moving.

19. The dustpan apparatus in accordance with claim 13 wherein said retaining means includes a rivet.

* * * * *